United States Patent [19]

Sussman

[11] 4,429,796

[45] Feb. 7, 1984

[54] INTERCONNECTED ONE-PIECE DESK UNIT

[76] Inventor: Howard Sussman, c/o F. F. Adams Inc., 700 NW. 8th Ave., Fort Lauderdale, Fla. 33311

[21] Appl. No.: 116,092

[22] Filed: Jan. 28, 1980

[51] Int. Cl.[3] ..... A47F 5/00

[52] U.S. Cl. ..... 211/11; 206/558; 211/189

[58] Field of Search ..... 211/11, 10, 126, 189; 108/54.1, 64; 206/558, 504; 220/23.4; 312/111

[56] References Cited

U.S. PATENT DOCUMENTS

| | | | |
|---|---|---|---|
| 3,595,179 | 7/1971 | Taylor | 108/64 X |
| 3,857,482 | 12/1974 | Shelton | 206/558 |
| 4,074,810 | 2/1978 | Juergens et al. | 211/11 |

FOREIGN PATENT DOCUMENTS

| | | | |
|---|---|---|---|
| 873707 | 6/1971 | Canada | 211/126 |

*Primary Examiner*—Ramon S. Britts
*Assistant Examiner*—Robert W. Gibson, Jr.
*Attorney, Agent, or Firm*—Bauer & Amer

[57] ABSTRACT

A convenience article of manufacture for use in storing paper clips and other such sundries and positioned, during such use, on a desk, consisting of three or more article-holding units interconnected so that they can be readily lifted as one piece, without coming apart, to thereby facilitate the movement thereof or merely to allow cleaning of the desk surface beneath the interconnected units. The interconnection consists of structural elements having a loose interfit that maintains the units together, and which "interfit" is adapted to bind together to provide a firmer connection during the lifting thereof, and thus be available to obviate the lifted article from disengaging during this crucial period.

4 Claims, 5 Drawing Figures

INTERCONNECTED ONE-PIECE DESK UNIT

The present invention relates generally to desk top storage units for paper clips, rubber bands, and other such sundries, and more particularly to standardized interconnecting structure for such units which, for all practical purposes, provides the use convenience of a one-piece unit.

The size, location, and number of storage compartments for a desk top unit is dictated, by and large, by the item being stored, i.e. paper clips, rubber bands, calendar pad, pencils, etc. To accommodate all of these sundries in a single unit would require a unit of excessive size, or one that at the least could not be readily economically mass produced by injection molding. To provide individual storage units would not be as objectionable from a production cost basis, but the number of such units detracts from the convenience in the use thereof since each must be individually handled preparatory to moving to another desk or location, or merely to allow cleaning of the desk top. Moreover, any solution which contemplates interconnecting the units in a friction fit or similar firm connection to obviate inadvertent disengagement, as during lifting, is not entirely satisfactory since such a connection is costly and more than is needed when the article is in stationary use on the desk.

Broadly, it is an object to provide an improved storage unit for desk top use overcoming the foregoing and other shortcomings of the prior art. More specifically, the inventive desk article hereof uses to advantage a loose interfit between adjacent units adequate for the stationary use thereof, and a firmer interconnection when the article is lifted to obviate, at such time, any inadvertent disengagement of such units.

An improved desk top article of manufacture demonstrating objects and advantages of the present invention is of the type formed of a cooperating arrangement of plural holders for sundry items interconnected into a one-piece unit for use on a desk surface. Each said holder includes a base having two vertically oriented opposite sides. On one such side there is a compartment-forming wall supported by opposite end connections such that the wall extends lengthwise of and in a clearance position therefrom. As a result, the referred to wall bounds a vertically oriented holder-connecting compartment. The other, or opposite side of each holder is comprised of a depending wall having notches formed therein at locations selected to align with the opposite end connections of the compartment-forming wall. Thus, adjacent holders, i.e. those having operative positions in side-by-side relation with each other, are readily interconnected with the depending wall of one said holder projected through the compartment of the other holder. Most important, each depending wall is sufficiently sized so as to be adapted to pivot into contact with a cooperating compartment-forming wall incident to the lifting of the holders. In this way, the "loose" connection is converted into one in which there is binding contact therebetween. Assuming a grouping of at least three said interconnected holders, this grouping when lifted under slight pressure applied inwardly at opposite ends, is thus adapted to retain its interconnected relation due to said established contact between said depending and compartment-forming walls. This, in an obvious way, contributes to facilitated cleaning of the desk surface beneath the lifted holders, as well as provides other noteworthy advantages in the handling and use of the holders.

The above brief description, as well as further objects, features and advantages of the present invention, will be more fully appreciated by reference to the following detailed description of a presently preferred, but nonetheless illustrative embodiment in accordance with the present invention, when taken in conjunction with the accompanying drawings, wherein.

Figure 1:
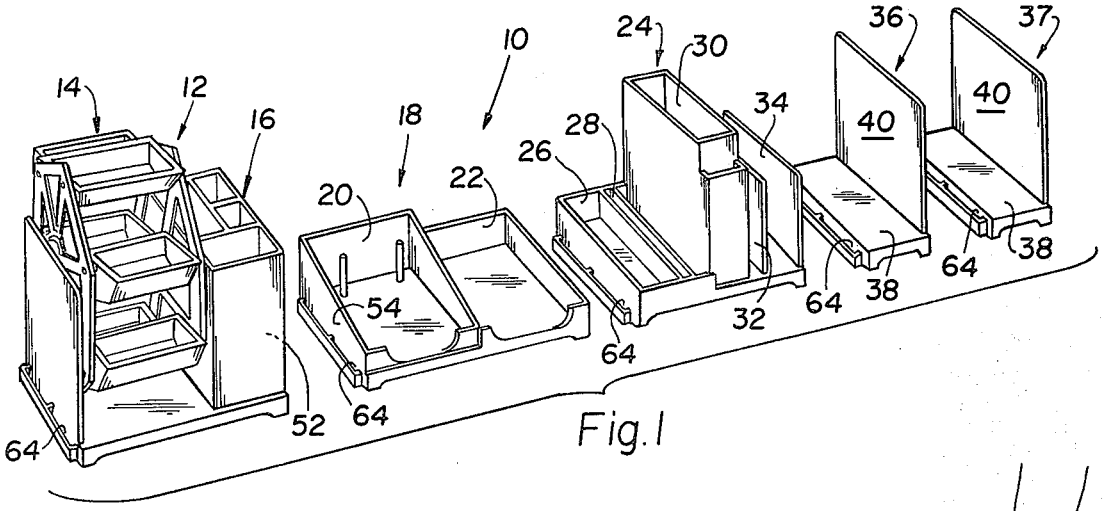
FIG. 1 is a perspective view of the improved desk top article of manufacture according to the present invention in unconnected or uncoupled relation.

The within article of manufacture is intended as a convenience product to be used on a desk top for the neat and orderly storage of sundry items typically used by an office worker. In FIG. 1, the overall unit, generally designated 10, is actually comprised of five individual structures which each embody a specific design enabling it to function as an effective holder for specific items. Thus, starting at the left, structure 12 has specific advantageous use as a holder for paper clips, rubber bands, coins, and other such items in a ferris wheel-type component 14 and as a holder for pencils, pens, markers, and the like in the compartments 16 thereof. The next or adjacent unit, generally designated 18, has structural features bounding a compartment 20 for a standard size desk calendar pad and an adjacent compartment 22 for note sheets. The next holder 24 is designed for rubber impression stamps and rubber bands in compartment 26 and in the adjacent narrower compartment 28 for business cards. Member 24 also includes a specially designed compartment 30 for envelopes and storage spaces 32, 34 delineated by vertical walls for incoming and outgoing mail. Completing a typical overall arrangement 10 would be identical holders 36, 37, each having a cooperating horizontally oriented base 38 and a vertical wall 40 designed for storing files.

The individual structural features embodied by the above referred to holders which permit each to function effectively as a storage holding structure for the particular item noted is not part of the within invention and therefore will not be described in detail herein. What does constitute the essence of the within invention are those structural features which it will be understood are embodied by each of the holders 12, 18, 24, and the identically constructed holders 36, 37 which enable their effective interconnection to thereby form an integrated or one-piece unit 10. Moreover, it will be understood that the interconnection, which will be described in greater detail subsequently, is effectively achieved even if it is desired to change positions of the holders. That is, the holders 12 and 24, or any other holders, can be interchanged in position without adversely affecting the interconnection of the holders and thus the formation of an integrated unit 10.

Figure 2:
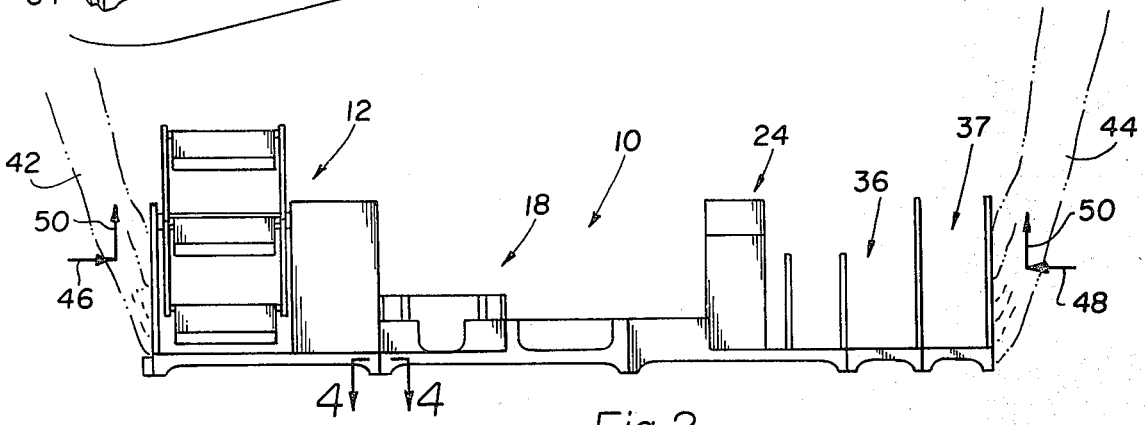
FIG. 2 is a front elevational view illustrating the FIG. 1 structure interconnected and while being lifted, during which the construction thereof contributes to maintaining said interconnected condition.

It is also important, and convenient to note at this time, that after the holders are interconnected that they can be readily lifted, without becoming disconnected, to either facilitate movement to another location or, as is more often the case, to permit cleaning of the desk surface that is beneath the unit. Lifting of the unit 10 is in accordance with a prescribed procedure in order to prevent the individual holders thereof from disconnecting, but this is readily achieved since the procedure is very simple. More particularly, and as is illustrated in FIG. 2, to lift the unit 10 it is recommended that the individual place his hands 42 and 44 against the end holders 12 and 37 in the manner illustrated, exert slight inward pressure in opposing directions 46, 48 and then raise the unit 10 in an ascending or lifting movement 50. Although unit 10 is, as already explained in relation to FIG. 1, an arrangement of individual holders 12, 18, etc., these holders do not disconnect for the reasons which will now be explained.

Figure 3:
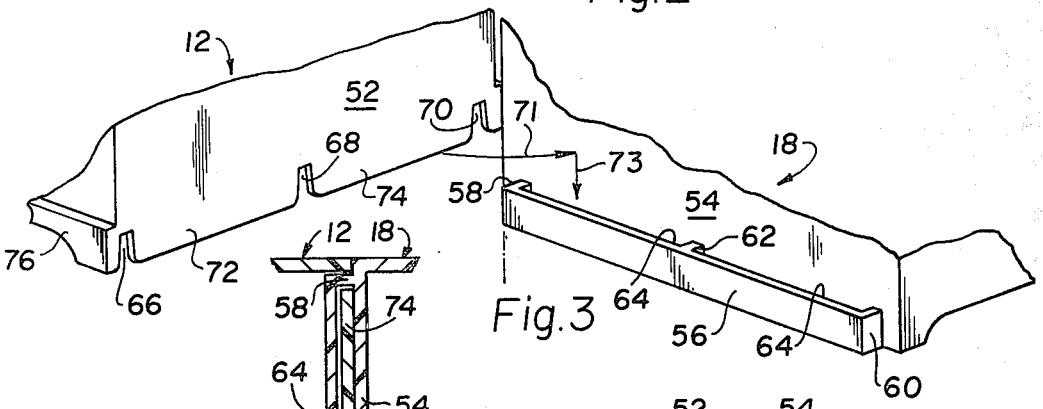
FIG. 3 is a partial isometric view illustrating the coupling components of adjacent units.
Figure 4:
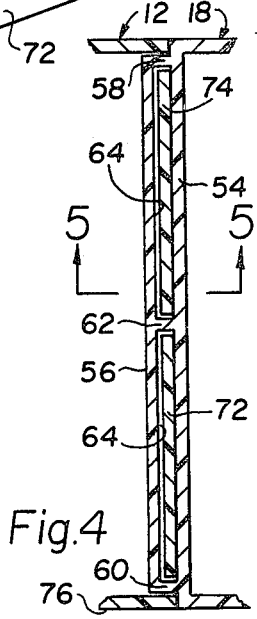
FIG. 4 is a sectional view, taken along line 4—4 of FIG. 2 on an enlarged scale, illustrating further structural details of the interconnection of adjacent units.

Referring briefly to FIG. 1, it is to be noted that a vertical wall of the compartment 16 of holder 12 is identified by the reference numeral 52, such wall because of its location being actually one side of this holder. The facing or side of compartment 20 of the adjacent holder 18 is denoted by the reference numeral 54. Referring now to FIG. 3, it will be understood that the structure illustrated therein are the walls 52 and 54 of the adjacent holders 12 and 18. In FIG. 3, however, these walls are provided with a perspective that more clearly illustrates those structural features thereon that provide the coupling elements for achieving interconnection of these adjacent holders. As clearly illustrated in FIG. 3, oriented horizontally along the base of the side 54 is a wall 56, preferably about 7/16ths of an inch in height, which is held at its opposite ends 58 and 60, and in the preferred embodiment illustrated also at a medial location 62, in spaced relation from side 54 so as to bound therebetween a holder-connecting compartment 64, said compartment in a preferred embodiment being approximately 3/16ths of an inch wide and approximately 5 inches long. Side 52 which is in facing relation to side 54 when the holders 12 and 18 are correspondingly placed in side-by-side position is designed, in accordance with the present invention, to have structural features which will advantageously use the compartment 64 to form an interconnection between the adjacent holders 12, 18. More particularly, and as clearly illustrated in FIG. 3, side 52 is formed with notches 66, 68 and 70 which are at locations selected to align with the walls 60, 62 and 58 which support the compartment-forming wall 56 on the side 54. Stated another way, the notches just referred to form two projections 72 and 74 in depending relation from the side 52. To interconnect the adjacent holders 12 and 18 holder 12 is moved into adjacent position, as indicated by arrow 71, in which the projections 72 and 74 are aligned with the two compartments 64 (or the one compartment subdivided by the medial connecting wall 62), and each projection then inserted, as in the direction 73, into its cooperating compartment. The interconnected relation of adjacent holders, as exemplified by the holders 12 and 18, is illustrated in FIG. 4. This figure also best illustrates how the recess inwardly of the notches 66 and 70 respectively provide opposite end walls 76 which mask the presence of the inwardly spaced end connecting walls 60 and 58 which bound the ends of the compartment 64.

Figure 5:
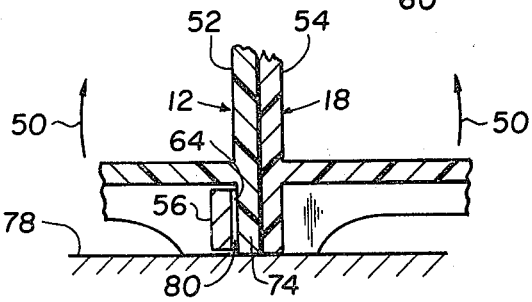
FIG. 5 is a partial elevational view in section, taken along line 5—5 of FIG. 4 illustrating further details of the interconnection of adjacent units.

Reference should now be made to FIG. 5 in which an effort has been made to illustrate the reason why the interconnected adjacent holders, as exemplified by holders 12 and 18 do not disconnect when urged through lifting movement 50 from the desk surface or other supporting surface 78. A slight inward pressure and lifting movement 50 causes interconnected adjacent holders 12 and 18 to cause slight pivoting movement in the projections 72, 74 in the compartment 64 with the result that the bottom edge of these projections 72, 74 make physical contact with the bottom edge of the wall 56, as at 80. Assuming that at least three interconnected holders are involved, since less than this number do not particularly present a problem as far as moving or cleaning beneath the units is concerned, the establishment of contact along the lines 80 between the adjacent units has the result of maintaining these units in their interconnected condition. In practice it has been found that the unit 10 may bow or sag slightly, but the individual units do not disconnect.

It will be understood that although each of the holders forming a part of the overall unit 10 is constructed differently according to the needs and storage requirements for the particular item involved, that each has on one side the previously described depending projections 72, 74 and on its opposite side the projection-receiving compartment 64. In FIG. 1 the orientation of the units is one that favors illustrating the compartment 64, but it will be understood that the opposite side of each of the holders also has the depending projections 72 and 74 as illustrated more particularly in FIG. 3.

From the foregoing description, it should be readily appreciated that there has been described herein an integrated desk unit 10 which, because it is comprised of individual holders or units, can be tailored specifically to the needs of the user by the selection of the holders that are utilized. Despite the fact, however, that the unit is modular, so to speak, the use of the novel coupling structure, as hereinbefore described, readily permits moving the unit 10 and, most important from a practical point of view, lifting the unit so that the desk surface beneath can be readily cleaned. A latitude of modification, change and substitution is intended in the foregoing disclosure, and in some instances some features of the invention will be employed without a corresponding use of other features. Accordingly, it is appropriate that the appended claims be construed broadly and in a manner consistent with the spirit and scope of the invention herein.

What is claimed is:

1. An improved desk top article of manufacture formed of a cooperating arrangement of plural holders for sundry items interconnected into a one-piece unit for use on a desk surface, each said holder comprising a base having two vertically oriented opposite sides, a compartment-forming wall supported by opposite end connections to extend lengthwise of and in a clearance position from one said opposite side so as to cooperate therewith in bounding a vertically oriented holder-connecting compartment, and said other opposite side being defined by a depending wall having notches formed therein at locations selected to align with said opposite end connections of said compartment-forming wall, adjacent holders having operative positions in side-by-side relation with said depending wall of one said holder projected through said compartment of an other said holder until establishing contact with said desk surface such that each said holder is supported on said desk surface with said opposite sides in contact therewith and in interconnected relation with each other, each said depending wall being sufficiently sized so as to be adapted to pivot into contact with a cooperating said compartment-forming wall incident to the lifting of said holders, whereby a grouping of at least three said interconnected holders are adapted when lifted under slight pressure applied inwardly at opposite ends to retain their interconnected relation due to said established contact between said depending and compartment-forming walls and wherein said lifted holders thereby contribute to facilitated cleaning of said desk surface beneath said holders.

2. The improved desk top article of manufacture as claimed in claim 1 wherein the vertical size of each said depending wall is at least 7/16 of an inch so as to contribute to said established contact being made adjacent the bottom edge of each said cooperating compartment-forming wall.

3. The improved desk top article of manufacture as claimed in claim 2 wherein each compartment-forming wall is additionally supported on a centrally located connection to said opposite side and each cooperating said depending wall has an additional centrally located notch adapted to align therewith.

4. The improved desk top article of manufacture as claimed in claim 3 wherein each said opposite end supporting connection of each said compartment-forming wall to said opposite side is located inwardly of said opposite side so as to contribute to said compartment-forming wall being masked from view by the opposite end portions of said depending wall in said projected position thereof into said compartment bounded by said compartment-forming wall.

* * * * *